United States Patent [19]

Mourier

[11] Patent Number: 4,661,744

[45] Date of Patent: Apr. 28, 1987

[54] ELECTROMAGNETIC ENERGY GENERATORS HAVING RESONATING CAVITY WITH REFLECTING ZONES

[75] Inventor: Georges Mourier, Le Port Marly, France

[73] Assignee: Thomson-CSF, Paris, France

[21] Appl. No.: 585,292

[22] Filed: Mar. 1, 1984

[30] Foreign Application Priority Data

Mar. 11, 1983 [FR] France ..... 83 04056

[51] Int. Cl.[4] ..... H01J 23/20; H01P 7/06

[52] U.S. Cl. ..... 315/4; 315/5; 333/228; 333/227; 331/79

[58] Field of Search ..... 333/219, 220, 221, 227, 333/228; 315/5, 4; 372/2, 4, 19, 92, 93, 94, 99, 98; 350/299, 294; 331/79, 96

[56] References Cited

U.S. PATENT DOCUMENTS

| | | | |
|---|---|---|---|
| 3,055,257 | 9/1962 | Boyd et al. | 372/92 |
| 3,267,383 | 8/1966 | Lohmann | 315/4 X |
| 3,518,427 | 6/1970 | Cotterill | 372/92 X |
| 3,688,218 | 8/1972 | Gleason | 372/19 X |
| 3,979,695 | 9/1976 | Erickson | 372/92 X |
| 4,179,192 | 12/1979 | Shafer | 350/299 X |
| 4,189,660 | 2/1980 | Dandl | 337/227 X |
| 4,287,488 | 9/1981 | Brau et al. | 372/2 |
| 4,496,913 | 1/1985 | Wandinger et al. | 333/227 |

FOREIGN PATENT DOCUMENTS

| | | | |
|---|---|---|---|
| 707253 | 6/1941 | Fed. Rep. of Germany . | |
| 576442 | 4/1946 | United Kingdom . | |
| 2096392 | 10/1982 | United Kingdom . | |
| 0777763 | 11/1980 | U.S.S.R. | 333/219 |
| 0530606 | 12/1980 | U.S.S.R. | 372/93 |
| 0938333 | 6/1982 | U.S.S.R. | 315/4 |

OTHER PUBLICATIONS

The Gyrotron by V. A. Flyagin, et al. in the IEEE Transactions on Microwave Theory and Techniques, vol. MTT-25, No. 6, Jun. 1977, pp. 514 through 521.

Design Considerations for a Megawatt CW Gyrotron by K. J. Kim, et al., in Int. J. Electronics, 1981, vol. 51, No. 4, pp. 434 and 435.

Proceedings of the IEEE, vol. 62, No. 11, Nov. 1974, New York (US).

IEEE Transactions on Microwave Theory and Techniques, vol. MTT-28, No. 12, Dec. 1980, New York (US).

Treacy, E. B., "The Two-Cone Open Resonator", *Proceedings of the IEEE,* vol. 54, No. 4, Apr. 1966, pp. 555-560.

Voytovich et al., "Axially Symnto Open Resoto with Orbiting Squeu Rings and Circular Cutout in One of Them", Radio Engineering & Electron Physics, vol. 15, #2, 1970.

*Primary Examiner*—Eugene R. LaRoche
*Assistant Examiner*—Benny T. Lee
*Attorney, Agent, or Firm*—Roland Plottel

[57] ABSTRACT

A generator of short electromagnetic waves is provided with a novel form of resonant cavity having improved mode selectivity. The reflecting walls of the cavity correspond to a surface of revolution and the meridian planes include four discrete mirror zones which face each other and are positioned so that the centers of the mirror zones form the vertex of a polygon and the normals to said mirror zones at the centers are bisectors of the angles formed at the vertices of the polygon.

9 Claims, 5 Drawing Figures

FIG_1
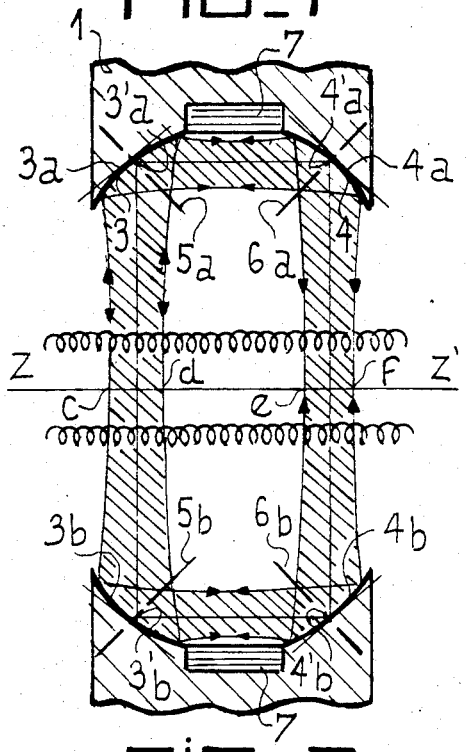
FIG_2-a
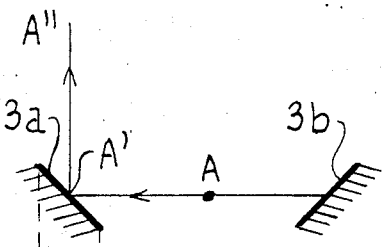
FIG_2-b
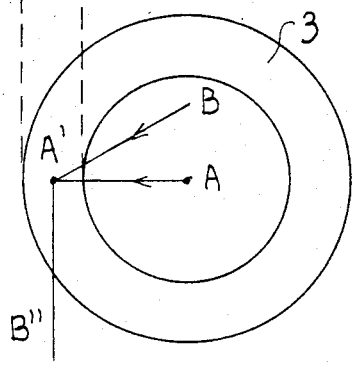
FIG_3
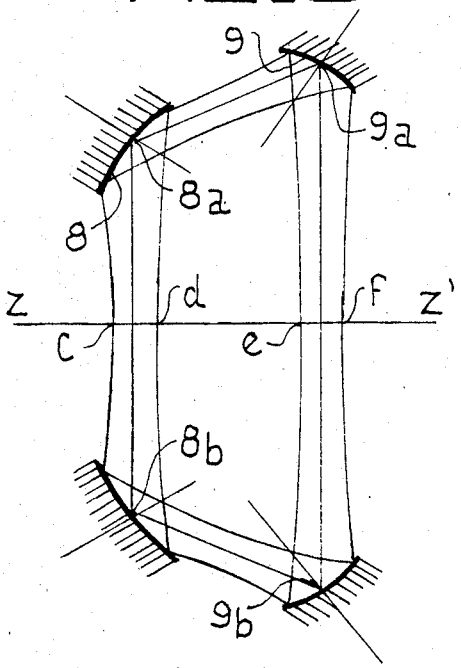
FIG_4
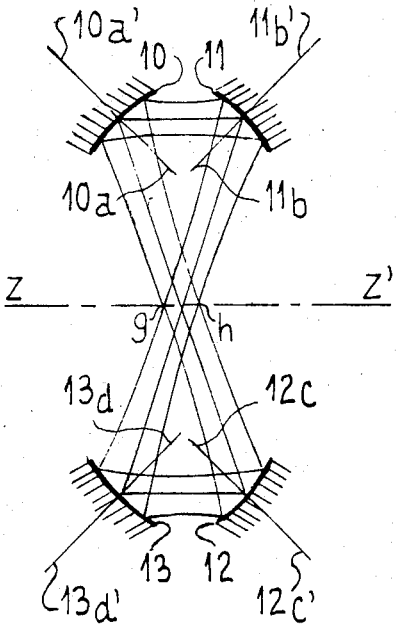

ELECTROMAGNETIC ENERGY GENERATORS HAVING RESONATING CAVITY WITH REFLECTING ZONES

BACKGROUND OF THE INVENTION

1. Field of the Invention

The present invention relates to a resonating cavity for ultra-high frequencies, more particularly a resonating cavity used in a generator operating at gigahertz frequencies, for example millimeter and submillimeter waves.

2. Description of the Prior Art

Among the generators of this type, generators in particular are known in which an electron beam is propagated along helical paths while guided by a uniform magnetic field along the axis of the helix. The beam passes through a resonating cavity in which the transverse speed components of the electrons interact with a transverse electric field component of the wave so as to amplify it. The cavities usually used in this type of generator are formed by cylindrical cavities or cavities with two spherical mirrors whose dimensions are calculated for operating in the $TE_{on}$ mode.

One of the problems often encountered with this type of cavity, particularly when it is desired to operate in a particular high order mode, results from the coexistence of several modes in the cavity, which causes a high probability of oscillations in an undesired mode.

SUMMARY OF THE INVENTION

Consequently, the aim of the present invention is to provide a resonating cavity for increasing the frequency separation of the electromagnetic modes, namely to eliminate a certain number of parasite modes.

Thus, the present invention has as object to provide a resonating cavity for ultra-high frequencies formed by a surface of revolution wherein, in each meridian plane, i.e. a plane including the axis of revolution, the surface of revolution forms at least four separate facing curved mirror zones, positioned so that the center of each mirror zone defines the apex or vertex of a polygon and so that the normal to said mirror zone at the center is directed along the corresponding bisector of the angle of the vertex of said polygon.

With such a structure using the properties of reflection and diffraction of the waves propagating in the cavity, it is possible to eliminate a certain number of non radial modes.

BRIEF DESCRIPTION OF THE DRAWINGS

Other features and advantages of the present invention will appear from reading the following description of different embodiments with reference to the accompanying drawings in which:

FIG. 1 is an axial section view of a first embodiment of a cavity in accordance with the present invention;

FIGS. 2*a* and 2*b* show schematically a sectional view and a top view of an annular mirror using the cavity of FIG. 1, in which views certain wave paths have been shown;

FIG. 3 is an axial sectional view of a second embodiment of a cavity in accordance with the present invention; and FIG. 4 is an axial sectional view of a third embodiment of the cavity in accordance with the present invention.

DESCRIPTION OF THE PREFERRED EMBODIMENTS

It will first of al be recalled, for correct understanding of the present invention, that the modes propagating in a resonant cavity may be analysed as flat waves which are reflected a certain number of times from the walls of the cavity.

On the other hand, in the case of $TE_{on}$ modes as is well known, the waves are propagated along the radii of a cylindrical cavity.

In a first embodiment shown in FIG. 1, the resonant cavity 1 of the present invention is formed principally by two curved annular mirrors 3–4 having the same axis ZZ', having more particularly a spherical zone shape. The two mirrors 3,4 which face each other are positioned so that, in each meridian plane, i.e. a plane through the axis of the surface of revolution they define four mirror zones 3*a*, 3*b*, 4*a*, 4*b* which face each other and whose respective centers 3'*a*, 3'*b*, 4'*a*, 4'*b* form the apices or vertices of a polygon, namely the four vertices of a rectangle in the embodiment shown. Furthermore, the four zones are inclined in the meridian plane so that the normal 5*a*, 5*b*, 6*a*, 6*b* to said mirror zones at the centers corresponds to the bisector of the angle at the corresponding vertex of the rectangle. Thus, in the embodiment shown, the mirrors are slanted at 45° with respect to the axis ZZ'. Thus, the useful electromagnetic waves, as explained hereafter, which are successively reflected from the different mirror zones follow the paths shown by arrows in FIG. 1, the hatched zones representing the zones where corresponding energy is concentrated. Moreover, as mentioned above, the mirror zones 3*a*, 3*b*, 4*a*, 4*b* have an appropriate curvature in the plane contaning the axis ZZ' the purpose of which is to concentrate the energy along axis ZZ' in two zones cd, ef of a length limited by a secondary effect due to diffraction.

Furthermore, between the two annular mirrors, the cavity is formed by surfaces 7 of material capable of absorbing the electromagnetic radiation incident there, thus avoiding reflection of any ray not along a radius crossing the axis.

The operation of the cavity forming the subject of the present invention will now be explained with reference to FIGS. 2*a* and 2*b* which illustrate the reflection of two incident rays on the surface of one of the mirrors 3 or 4 forming the cavity of FIG. 1. In the case of a ray A corresponding to a propagation radius of a $TE_{on}$ mode, it strikes the mirror zone 3*a* at A' and is reflected vertically at A" because of the 45° slope of the mirror, as shown in FIG. 2*a*, the ray then following the propagation path shown in FIG. 1. In the case of a ray B not passing through the axis and also striking the mirror zone at A', it is reflected in a direction B". The result is that the rays B" will not all strike the second annular mirror and that the non radial modes will undergo losses by diffraction greater than the radial modes, which will prevent excitation thereof. Thus, with this type of cavity, an increase in the separation of the frequencies is obtained by eliminating a part of the modes other than the $TE_{on}$ modes.

In the case of the cavity shown in FIG. 1, it has two interaction zones, cd, ef with the electron beam. It is thus possible to achieve premodulation of the electron beam during the first interaction, namely in zone cd, the essential part of the energy transferred from the beam to the wave occuring during the second interaction, namely at the level of zone ef. To improve the efficiency of this procedure, the annular mirrors may be, as shown in FIG. 3, formed by two dissymmetrical annular mirrors 8, 9 having different radii in the meridian plane. In this case, the polygon of the centers of the mirror zones 8*a*, 8*b*, 9*a*, 9*b* is formed by an isoscele trapezium. In FIG. 3, the path of electric propagation and the zones where the energy is concentrated are shown in the same way as in FIG. 1. The path followed by the electromagnetic waves in the cavity of FIG. 3 is identical to that of FIG. 1, the only difference residing in the fact that the interaction zone cd is larger than the interaction zone ef, which causes a higher energy concentration in zone ef.

In some cases, it is advantageous to have only one interaction zone. To achieve this condition, the mirror zones 10, 11, 12, 13 are positioned as shown in FIG. 4. The mirror zones 10, 11, 12, 13 are obtained from four mirrors in the shape of a spherical or parabolic calotte or skull cap disposed, for example, about axis ZZ' which remains the axis of symmetry of the electron beam and of the magnetic field. Each mirror now has its own axis 10*a*—10*a*', 11*b*—11*b*', 12*c*—12*c*', 13*d*—13*d*' and the polygon having the above axes as bisector is formed by two triangles opposed by their apices.

It is also possible to obtain a single interaction zone by using, in place of the four spherical skull-cap shaped mirrors each having their axis of symmetry, two mirrors with spherical zone shape sloped appropriately in the meridian plane.

With this arrangement a higher concentration of electromagnetic energy is obtained in the region gh of the electron beam. Furthermore, at resonance, the successive radial modes correspond to a variation of the phase by 2 when it is reckoned along a complete path of the ray on itself. The result is that one radial mode out of two corresponds to phase opposition fields in the region of the axis. Thus, only one radial mode out of two may interact.

In the cavities of FIGS. 3 and 4, the surfaces surrounding the mirrors are formed by elements absorbing the electromagnetic radiation present or by surfaces coated with an absorbing layer made for example from Carberlox, a mixture of carbon and bexyllium oxide.

The above described cavities are used more particularly in radioelectric wave generators of the gyrotron type. However, it is evident for a man skilled in the art that these cavities may be used in other applications requiring separation of the modes.

In the case of an amplifier, energy of the desired wavelength to be amplified is introduced into the input cavity or abstracted from the output cavity either by a probe inserted in the cavity or by an opening in a wall of the cavity. In an oscillator, only a single cavity need be used, since as is usual in electron beam oscillators noise modulation on the electron beam provides the initial excitation of the cavity at its resonant wavelength and this energy modulates the beam further which leads to increased excitation of the cavity until a stable level of oscillations is reached. Such energy is then abstracted either by a probe or an opening in the cavity wall.

The principles of the invention are applicable to any wavelength at which cavities of the kind described are practical.

What is claimed is:

1. A generator of millimeter and submillimeter waves such as gyrotron comprising means forming an electron beam along a beam axis and cavity resonator means disposed along the beam axis for providing at least one interaction region along the beam axis between the electron beam and an electromagnetic field, characterized in that the cavity comprises reflecting walls which correspond to a particular surface of revolution and so have revolution symmetry about the beam axis and that the reflecting walls also form, in each meridian plane through the beam axis, at least four separate curved reflecting zones for reflecting radial modes of said electromagnetic field, said reflecting zones positioned so that the centers of the reflecting zones form each of the vertices of a polygon, and the normal to the center of each reflecting zone is the bisector of the angle formed at the corresponding vertex, the curved reflecting zones being dimensioned and positioned to obtain said at least one interaction region which is a limited portion of the beam axis enclosed within the cavity so that non-radial modes of said electromagnetic field cannot reflect in all said reflecting zones and are thus eliminated.

2. A generator in accordance with claim 1 in which there are at least two reflecting walls which are spaced apart and the space between the two reflecting walls includes an absorbing material which absorbs electromagnetic field radiations.

3. A generator in accordance with claim 1 further characterized in that the resonator means includes a pair of interaction regions spaced apart along the beam axis.

4. A generator in accordance with claim 1 further characterized in that the resonator means includes only a single interaction region along the beam axis.

5. A generator in accordance with claim 1 further characterized in that the reflecting walls of the cavity are formed by a pair of annular mirrors spaced apart along the beam axis.

6. A generator in accordance with claim 5 in which the two mirrors are symmetrical.

7. A generator in accordance with claim 5 in which the two mirrors are assymmetrical.

8. A generator in accordance with claim 5 in which the annular mirrors have the shape of spherical zones.

9. A generator in accordance with claim 5 in which the annular mirrors have the shape of parabolic zones.

* * * * *